US009585461B2

(12) United States Patent
Kusukame et al.

(10) Patent No.: US 9,585,461 B2
(45) Date of Patent: Mar. 7, 2017

(54) METHOD OF PRODUCING AN ADHESIVE SHEET FOR SKIN, COSMETIC METHOD AND ADHESIVE SHEET FOR SKIN

(71) Applicant: Panasonic Intellectual Property Management Co., Ltd., Osaka (JP)

(72) Inventors: Haruka Kusukame, Nara (JP); Tomoki Masuda, Osaka (JP); Masayo Shinoda, Tokyo (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 14/643,014

(22) Filed: Mar. 10, 2015

(65) Prior Publication Data

US 2015/0265030 A1 Sep. 24, 2015

(30) Foreign Application Priority Data

Mar. 18, 2014 (JP) ..... 2014-054638

(51) Int. Cl.
*A45D 40/26* (2006.01)
*A45D 44/00* (2006.01)

(52) U.S. Cl.
CPC ..... *A45D 44/002* (2013.01)

(58) Field of Classification Search
CPC ..... A45D 40/30; A45D 40/0087; A45D 2029/005; A45D 44/002; A45D 2200/1009; A45D 2200/1028; A45D 2200/1027; A45D 2200/1036; A61K 8/02; A61K 8/0208; A61K 8/0212; A61Q 1/00; A61Q 1/02; A61Q 1/08; A61Q 1/10; A61Q 19/00; B44C 1/24; B44C 1/16; B44C 1/17; B44C 1/1708; B41M 3/12; B41M 5/502; B41M 5/504; B41M 5/506; B41M 5/508
USPC ..... 132/320, 200, 73, 317, 319; 604/303; 606/131
See application file for complete search history.

(56) References Cited

U.S. PATENT DOCUMENTS 5,503,076 A * 4/1996 Yeo ..... D04H 13/006 101/483
5,523,149 A 6/1996 Kijimuta et al.
(Continued)

FOREIGN PATENT DOCUMENTS

JP 2-276670 11/1990
JP 7-076161 3/1995
(Continued)

*Primary Examiner* — Rachel Steitz
(74) *Attorney, Agent, or Firm* — McDermott Will & Emery LLP

(57) ABSTRACT

A method of producing an adhesive sheet for skin includes attaching a water-absorptive support to a water-permeable biocompatible film to prepare a stack including the biocompatible film and the support, applying an aqueous ink including water and a functional material to the biocompatible film side of the stack thereby to fix the functional material to the biocompatible film, and separating the biocompatible film having the functional material fixed thereto from the support. An adhesive sheet for skin comprises a water-permeable biocompatible film to which an aqueous ink including water and a functional material has been applied and fixed and a water-absorptive support detachably attached to the biocompatible film.

16 Claims, 2 Drawing Sheets

(56) References Cited

U.S. PATENT DOCUMENTS 5,958,560 A * 9/1999 Ewan ..... B41M 3/12 427/149
6,062,234 A * 5/2000 Finocchiaro ..... A45D 33/00 132/294
6,106,852 A * 8/2000 Vineberg ..... A61K 8/0208 424/402
6,299,967 B1 * 10/2001 Collins ..... B41M 3/12 428/32.12
6,503,232 B1 * 1/2003 Kawai ..... A61F 13/126 602/48
6,702,792 B2 * 3/2004 Nakamura ..... A45D 40/30 604/303
8,506,073 B2 * 8/2013 Liang ..... B41M 3/12 156/230
8,545,613 B2 * 10/2013 Blette ..... A61K 8/345 106/31.03
8,865,276 B2 * 10/2014 Ito ..... B41M 5/502 428/32.18
9,011,394 B2 * 4/2015 Gueret ..... A61K 8/0212 132/320
9,113,692 B2 * 8/2015 Khan ..... A45D 40/00
2006/0025307 A1 * 2/2006 Tamagawa ..... B41M 5/41 503/227
2006/0246266 A1 * 11/2006 Hall ..... B44C 1/1758 428/195.1
2008/0053476 A1 * 3/2008 LaHood ..... A45D 40/30 132/320
2009/0155498 A1 * 6/2009 Nakashima ..... C09K 9/00 428/29
2010/0228204 A1 * 9/2010 Beatty ..... A45D 44/002 604/303
2011/0073125 A1 * 3/2011 Iosilevich ..... A45D 44/002 132/200
2011/0300196 A1 * 12/2011 Mohammadi ..... A45D 44/002 424/401
2012/0037291 A1 * 2/2012 Goolishian ..... G09F 21/02 156/62
2013/0127953 A1 * 5/2013 Furukawa ..... C09D 11/107 347/68
2013/0337225 A1 * 12/2013 Beal ..... B41M 5/025 428/141
2014/0352031 A1 * 12/2014 Choi ..... A45D 44/002 2/173
2015/0059800 A1 * 3/2015 Shinoda ..... A45D 40/261 132/320
2015/0125499 A1 * 5/2015 Ochiai ..... A45D 44/002 424/401

FOREIGN PATENT DOCUMENTS

JP 11-291622 10/1999
JP 2000-127613 5/2000
JP 2001-039014 2/2001
JP 2005-035172 2/2005
JP 2006-263961 10/2006
JP 2008-062588 3/2008
JP 2014-185089 10/2014

* cited by examiner

METHOD OF PRODUCING AN ADHESIVE SHEET FOR SKIN, COSMETIC METHOD AND ADHESIVE SHEET FOR SKIN

BACKGROUND

1. Technical Field

The present disclosure relates to methods of producing an adhesive sheet for skin, cosmetic methods and adhesive sheets for skin.

2. Description of the Related Art

Direct printing on substrates having low ink absorbability such as plastic sheets encounters a problem that the substrates repel aqueous inks generally used in ink jet printing.

For example, Japanese Unexamined Patent Application Publication No. 2-276670 solves this problem by applying inks to an ink absorptive alumina hydrate layer stacked onto a transparent film having low ink absorbability.

SUMMARY

In such printing methods where inks are applied to an ink absorptive layer stacked onto a sheet with low (or no) ink absorbability, a problem remains in that the thickness of the stack is large.

One non-limiting and exemplary embodiment provides an adhesive sheet for skin having small thickness.

In one general aspect, the techniques disclosed here feature a method of producing an adhesive sheet for skin including attaching a water-absorptive support to a water-permeable biocompatible film to prepare a stack including the biocompatible film and the support, applying an aqueous ink including water and a functional material to the biocompatible film side of the stack thereby to fix the functional material to the biocompatible film, and separating the biocompatible film having the functional material fixed thereto from the support.

It should be noted that general or specific embodiments may be implemented as an apparatus, a system, a sheet, a method, or any selective combination thereof.

The method of producing an adhesive sheet for skin of the present disclosure may produce adhesive sheet for skins having small thickness. Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

DETAILED DESCRIPTION

Figure 1:
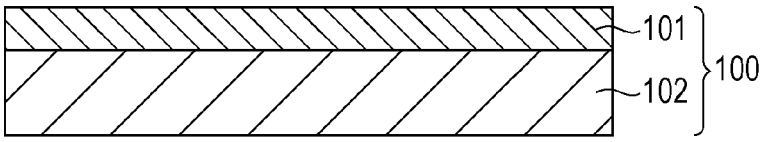
FIG. 1 is a sectional view of a cosmetic sheet in Embodiment 1.

Underlying Knowledge Forming Basis of the Present Disclosure

The present inventors have studied cosmetic sheets for use in such fields as cosmetics and medical cares which may be applied to skin as makeup to conceal scars on the skin or to minimize the appearance of spots or wrinkles. The studies by the present inventors have revealed that thick sheets do not look like normal skin and are difficult to affix to skin without adhesives. Thus, the present inventors have found that such sheets need to be thin. Further, the present inventors have noticed that previously colored sheets often do not agree with the actual color of skin, and are applicable to a limited number of makeup patterns. With such problems, the present inventors have studied sheet-printing techniques in order to obtain such colored sheets that makeup patterns and colors may be customized to individuals. However, it has been found that printing on thin sheets results in a failure for the inks to fix on the sheets due to the low water absorbability of such thin sheets.

The present inventors have studied printing methods capable of fixing inks onto thin sheets. As a result, it has been found that a stack in which a support having high water absorbability is disposed under a water-permeable thin sheet layer can allow an ink containing at least water to be fixed to the thin sheet, the ink being applied from the thin sheet side. Further, the present inventors have also found that a print composed of the thin sheet may be obtained by separating the support after the printing.

As mentioned earlier, the conventional sheets are coated with ink receptor layers because of the inability of the sheets to be colored directly on the surface. Thus, conventional prints obtained by applying inks to the receptor layers have a problem in that the thickness of the final prints is large. This problem may be remedied by the above findings.

One general aspect of the present disclosure resides in a method of producing an adhesive sheet for skin including attaching a water-absorptive support to a water-permeable biocompatible film to prepare a stack including the biocompatible film and the support, applying an aqueous ink including water and a functional material to the biocompatible film side of the stack thereby to fix the functional material to the biocompatible film to obtain the adhesive sheet for skin comprising the biocompatible film having the functional material fixed thereto and the support, and separating the biocompatible film having the functional material fixed thereto from the support.

The aqueous ink may be applied by printing. The biocompatible film may have a film thickness of 10 nm to 800 nm both inclusive. The ink may further include glycerol. The ink may further include a diol solvent. The support may have a water absorbing capacity of not less than 1 mg per 1 $mm^2$.

Another general aspect of the present disclosure resides in a cosmetic method including attaching a water-absorptive support to a water-permeable biocompatible film to prepare a stack including the biocompatible film and the support, applying an aqueous ink including water and a coloring material to the biocompatible film side of the stack thereby to fix the coloring material to the biocompatible film, separating the biocompatible film having the coloring material fixed thereto from the support, and applying the separated biocompatible film to skin.

Another general aspect of the present disclosure resides in an adhesive sheet for skin including a water-permeable biocompatible film to which an aqueous ink including a functional material has been applied and fixed and a water-absorptive support detachably attached to the biocompatible film.

The aqueous ink may have been applied by printing. The biocompatible film may have a film thickness of 10 nm to 800 nm both inclusive. The ink may further include glycerol. The ink may further include a diol solvent. The support may have a water absorbing capacity of not less than 1 mg per 1

$mm^2$. The functional material may be a coloring material, and the adhesive sheet for skin may be a cosmetic sheet.

Embodiments discussed below illustrate specific examples of the present disclosure. The configurations described in the following embodiments such as values, shapes, constituent elements and materials are only illustrative and do not limit the scope of the present disclosure. Of the constituent elements in the following embodiments, those that are not described in independent claims representing the broadest concept are illustrated as optional constituent elements. The respective contents in all the embodiments may be appropriately combined.

The following embodiments illustrate a dermatological cosmetic sheet as an example.

EMBODIMENTS

A printing method in one embodiment will be described below.

Figure 2:
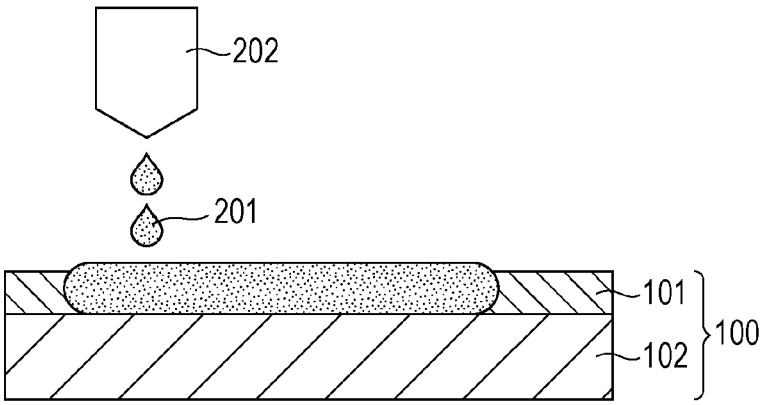
FIG. 2 is a sectional view of ink jet printing in Embodiment 1.
Figure 3:
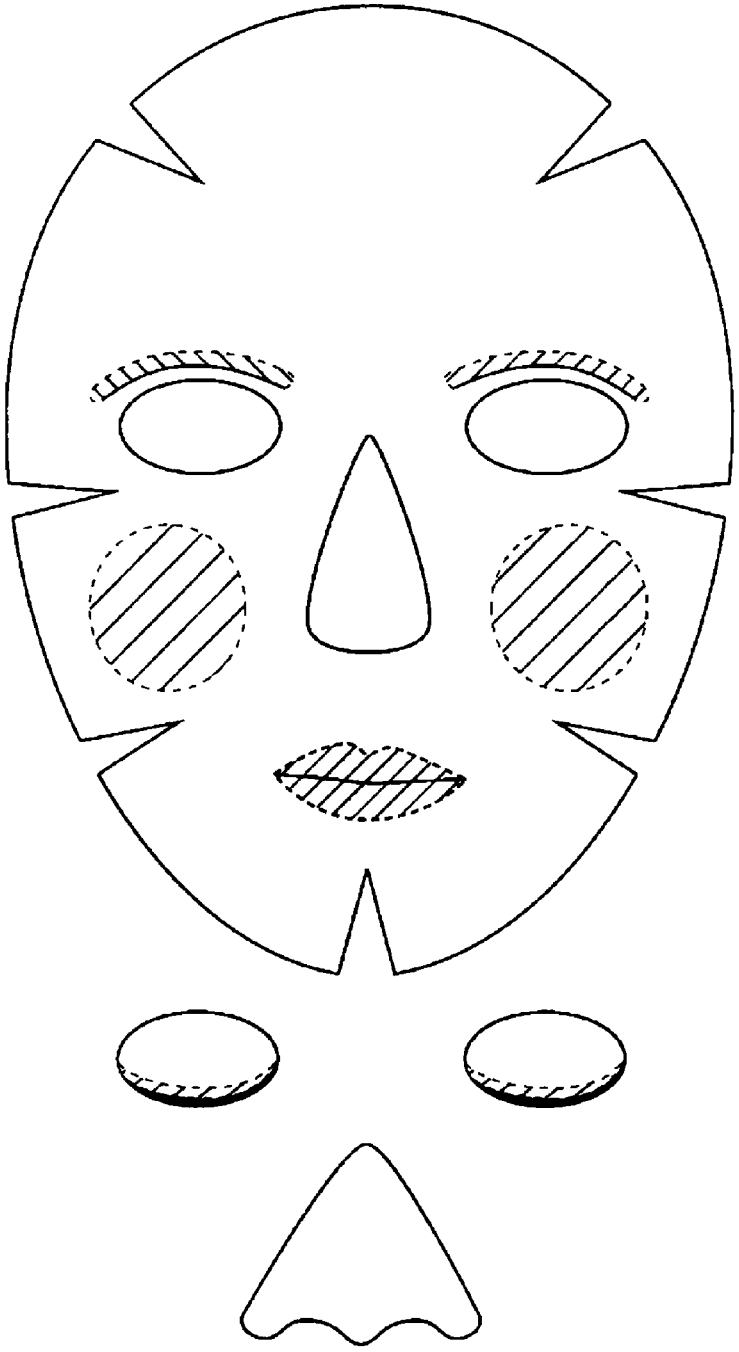
FIG. 3 is a schematic view of an adhesive sheet for skin in Embodiment 1.

FIG. 1 is a sectional view illustrating a printing stack 100 in the form of a sheet (also written as "printing sheet"). As illustrated in FIG. 1, the printing stack 100 includes a thin cosmetic sheet (also written simply as "thin film") 101 and a support 102. For example, the printing sheet 100 is set on an ink jet printing machine and, as illustrated in FIG. 2, an aqueous ink 201 including at least a functional material and water is dropped onto the thin cosmetic sheet 101 side of the printing sheet 100 with use of an ink jet head 202. The liquid of the droplets of the ink 201, such as water, permeates the water-permeable thin cosmetic sheet 101 and is absorbed by the support 102. On the other hand, the functional material that is another component of the ink 201 remains in the thin cosmetic sheet 101 and is dried and fixed in the thin cosmetic sheet 101. Here, the functional material is a coloring material such as a pigment or a dye, and/or a solid component such as a binder resin. Next, as illustrated in FIG. 3, the thin cosmetic sheet 101 is cut into a shape of a face.

After the fixation, the thin cosmetic sheet 101 and the support 102 are separated from each other. This results in a thin print in which a pattern is printed in the thin cosmetic sheet. This print may be applied to the skin of a face as easy makeup. Since the print is thin, the print adheres to the skin by itself without adhesives.

While the present embodiment illustrates an ink jet method as the printing method, the printing method is not limited to an ink jet method. The ink may be applied by any method other than printing, for example, by a blowing method such as spraying.

The ink used in the ink jet printing is an aqueous mixture. The solvent other than water of the mixture is not particularly limited but desirably includes glycerol. Glycerol has a higher boiling point than water and is water-absorptive. Thus, the addition of glycerol makes the ink resistant to drying and thereby suppresses the occurrence of the clogging of a nozzle of an ink jet head. Further, it is desirable that the ink include glycerol and at least one diol solvent. Diol solvents have a lower viscosity than water or glycerol and also have low surface tension. These properties provide good wetting properties with respect to sheets. Consequently, the ink exhibits enhanced penetration or permeation properties and the ink fixation is facilitated. Examples of the diol solvents in the present embodiment include diethylene glycol, propane diol, butylene glycol, pentane diol and hexane diol.

The aqueous ink may further include a water-insoluble colorant, a surfactant or a mixture thereof.

Of the water-insoluble colorants, pigments are desirably used. Pigments are insoluble or negligibly soluble in water and are resistant to fading due to light, gas or the like. Thus, pigmented ink compositions can give print records which may be stored in a good state because of the excellent resistance to water, gas, light and the like. The pigments may be any of known inorganic pigments, organic pigments and carbon blacks.

It is also desirable that the aqueous ink further include a water-soluble resin and/or thermoplastic resin particles. With this configuration, the resin increases the adhesion of the colorant to the sheets. That is, friction resistance or rubbing resistance may be imparted to the prints, and the printed thin cosmetic sheet may be worn on a face while being prevented from fading due to friction in daily life.

Here, the thin cosmetic sheet 101 is a biocompatible material. The biocompatible materials as the thin films 101 are not particularly limited and may be any such thin films. Examples of the materials for the thin films in the present embodiment include polyesters such as polyglycolic acid, polylactic acid, polycaprolactone, polyethylene succinate, polyethylene terephthalate and copolymers thereof, polyethers such as polyethylene glycol and polypropylene glycol, polyamides such as nylon, polyglutamic acid, polyasparaginic acid and salts thereof, polysaccharides such as pullulan, cellulose, starch, chitin, chitosan, alginic acid, hyaluronic acid and corn starch, salts of these polysaccharides, silicones such as acrylic silicone and trimethylsiloxysilicic acid, acrylic acids such as alkyl acrylates, silicone acrylates, acrylic acid amides and copolymers thereof, polyvinyl alcohols, polyurethanes, polycarbonates, polyacid anhydrides, polyethylenes and polypropylenes.

Although the present embodiment illustrates the dermatological cosmetic sheets having a biocompatible material, the biocompatible materials are not necessarily used in other applications. That is, the use of other materials is within the scope of the present disclosure. The thickness of the thin cosmetic sheet 101 is desirably 10 nm to 3000 nm (or 10 nm to 3 μm), both inclusive. In particular, the thickness is desirably 10 nm to 1000 nm both inclusive. One of the reasons why such a film thickness is desirable is because sheets having a smaller film thickness exhibit higher water permeability and allow for easy penetration of the liquid component in the ink that has been applied. Another reason is because a decrease in film thickness results in an increase in the adhesion with respect to the support and also leads to a decrease in the amount of an air layer present between the thin cosmetic sheet and the support, thus making it easier for the water that has permeated the thin cosmetic sheet to be absorbed into the water-absorptive support.

The support 102 may be a material having high water absorbability, with examples including paper, cloth, nonwoven fabrics, woven fabrics, porous layer coating sheets, nanofiber sheets, water-absorptive polymers and water-soluble polymers. The amount of water absorption per unit area of the support is desirably not less than 1 mg, more desirably not less than 3 mg, and still more desirably not less than 4 mg per 1 $mm^2$. The water absorption rate is appropriately such that the support can absorb as much water as not less than 10%, desirably not less than 50%, and more desirably not less than 100% by weight relative to the weight of the support itself. The thickness of the support 102 is not particularly limited, but is desirably not less than 10 μm. The material of the support 102 formed in such a thickness ensures a high water absorption rate. Further, an increase in the thickness of the support 102 increases the speed of water absorption and thus promotes ink fixation. Furthermore, the support 102 having such a thickness can absorb a large volume of water and is not saturated even when an increased amount of the ink is applied.

(Measurement of Water Absorbing Capacity of Materials Used as Supports)

The water absorbing capacity of materials used as supports in Examples described later was measured.

Specifically, three types of sheets: filter paper, cellulose nonwoven fabric and photographic glossy printing paper were provided. Each of the sheets was soaked in water for 1 minute, and the weight of the sheet before and after the absorption of water was measured. The water temperature was 22° C. The water absorption rate was calculated from the change in the weight of the sheet. Further, the sheet area was measured, and the amount of water absorption per unit area was calculated.

Here, the water absorption rate was determined using the equation: Water absorption rate={(M2−M1)/M1}×100%, wherein M1 is the weight of the sheet before the soaking in water (namely, in a dry state) and M2 is the weight of the sheet after the soaking in water.

The amount of water absorption per unit area (mg/mm$^2$) was determined using the equation: Amount of water absorption=(M2−M1)/A, wherein A is the area of the sheet.

Here, the measurement data were obtained by averaging the results of three experiments performed with respect to three samples (each sample tested one time) fabricated from the same material by the same method. The results are described in Table 1.

TABLE 1

| | Water absorption rate (%) | Amount of water absorption per unit area (mg/mm$^2$) |
|---|---|---|
| Filter paper | 149.56 | 4.79 |
| Nonwoven fabric | 88.99 | 1.19 |
| Photographic printing paper | 8.47 | 2.12 |

Of the support materials used in Examples below, glass and PET films were not subjected to the measurement of water absorbing capacity. The water absorbing capacity of such materials is estimated to be substantially zero.

Example 1

Because the present inventors have conducted experiments focused in particular on thin cosmetic sheets (thin films) 101 including polylactic acid, there will be described below Examples involving polylactic acid sheets.

Polylactic acid sheets having a film thickness of 200 nm were attached to each of the five types of supports: filter paper, cellulose nonwoven fabric, photographic glossy printing paper, glass and PET film. Specifically, each of the mating surfaces of the polylactic acid sheet and the support was wet with water, and the wet surfaces of the sheet and the support were attached to each other and were dried for at least 12 hours. With use of an ink jet printer, a square solid pattern image 5 mm in length and 15 mm in width was printed on the polylactic acid sheet side of the printing stack sheet fabricated above. The ink used had a composition including water as a medium, 10 wt % of glycerol and 10 wt % of propanediol as additional solvents, 25 wt % of a dispersion of yellow iron oxide as an inorganic pigment (WD-TIOY30 manufactured by DAITO KASEI KOGYO CO., LTD.), and 2.5 wt % of an acrylic emulsion (DAITOSOL 3000SLPN manufactured by DAITO KASEI KOGYO CO., LTD.). The printed sheets were allowed to stand at room temperature or 50° C. for a prescribed time, and the ink fixation properties under the respective conditions of the standing for the prescribed time were evaluated. The ink fixation properties were evaluated based on whether or not the ink was transferred to a piece of tissue paper pressed against the printed pattern, and were rated in 4 grades: ⊙: The ink was fixed within 5 minutes. ○: The ink was fixed within 10 minutes. Δ: The ink was fixed within 30 minutes. x: The ink was not fixed in 30 minutes.

Table 2 describes the results of the experiments which evaluated the ink fixation properties of the 200 nm polylactic acid sheets stacked onto the various supports.

TABLE 2

| | | Supports | | | | |
|---|---|---|---|---|---|---|
| | | Filter paper | Nonwoven fabric | Photographic printing paper | Glass | PET |
| Ink fixation properties | Room temperature | ⊙ | ○ | Δ | X | X |
| | 50° C. | ⊙ | ○ | ⊙ | X | X |

The results described in Table 2 show that the ink fixation properties were greatly changed depending on the types of supports. It was demonstrated that desirable results were obtained when the supports were made of materials having high water absorbability, namely, filter paper, nonwoven fabric and printing paper. On the other hand, ink fixation failed when the supports were glass or PET films having low water absorbability.

Example 2

Polylactic acid sheets having a film thickness of 200 nm were attached to filter paper. Specifically, each of the mating surfaces of the polylactic acid sheet and the support was wet with water, and the wet surfaces of the sheet and the support were attached to each other and were dried for at least 12 hours. With use of an ink jet printer, a square solid pattern image 5 mm in length and 15 mm in width was printed on the polylactic acid sheet side of the printing stack sheet fabricated above. The five types of inks described in Table 3 were used in the ink jet printing.

TABLE 3

| | | Inks | | | | |
|---|---|---|---|---|---|---|
| | | Ink 1 | Ink 2 | Ink 3 | Ink 4 | Ink 5 |
| Compositions of inks | Solvents | Glycerol 10 wt % Propanediol 10 wt % | Glycerol 10 wt % Pentanediol 10 wt % | Glycerol 10 wt % Propanediol 10 wt % | Glycerol 20 wt % | Glycerol 30 wt % |

TABLE 3-continued

| | Inks | | | | |
|---|---|---|---|---|---|
| | Ink 1 | Ink 2 | Ink 3 | Ink 4 | Ink 5 |
| | | | Pentanediol 10 wt % | | |
| Pigment dispersion | WD-TIOY30 25 wt % | WD-TIOY30 25 wt % | WD-TIOY30 25 wt % | WD-TIOY30 25 wt % | WD-TIOY30 25 wt % |
| Resin | DAITOSOL 3000SLPN 2.5 wt % | DAITOSOL 3000SLPN 2.5 wt % | DAITOSOL 3000SLPN 2.5 wt % | DAITOSOL 3000SLPN 2.5 wt % | DAITOSOL 3000SLPN 2.5 wt % |

The printed sheets were allowed to stand at room temperature or 50° C. for a prescribed time, and the ink fixation properties under the respective conditions of the standing for the prescribed time were evaluated. The ink fixation properties were evaluated based on whether or not the ink was transferred to a piece of tissue paper pressed against the printed pattern, and were rated in 4 grades: ⊙: The ink was fixed within 5 minutes. ○: The ink was fixed within 10 minutes. Δ: The ink was fixed within 30 minutes. x: The ink was not fixed in 30 minutes.

Table 4 describes the results of the experiments which evaluated the ink fixation of the inks described in Table 3 to the 200 nm polylactic acid sheets.

TABLE 4

| | | Inks | | | | |
|---|---|---|---|---|---|---|
| | | Ink 1 | Ink 2 | Ink 3 | Ink 4 | Ink 5 |
| Ink fixation properties | Room temperature | ⊙ | ⊙ | ⊙ | ○ | ○ |
| | 50° C. | ⊙ | ⊙ | ⊙ | ○ | ○ |

The results described in Table 4 show that the ink fixation properties were changed depending on the compositions of the inks. It was demonstrated that desirable results were obtained when the ink was based on a mixed solvent including water, glycerol and a diol, namely, propanediol or pentanediol, as compared to when the ink was based on a mixed solvent including water and glycerol.

Example 3

Polylactic acid sheets having a film thickness of 200 nm, 500 nm or 1000 nm were attached to filter paper. Specifically, each of the mating surfaces of the polylactic acid sheet and the support was wet with water, and the wet surfaces of the sheet and the support were attached to each other and were dried for at least 12 hours. With use of an ink jet printer, a square solid pattern image 5 mm in length and 15 mm in width was printed on the polylactic acid sheet side of the printing stack sheet fabricated above. The ink used had a composition including water as a medium, 10 wt % of glycerol, 10 wt % of propanediol, 25 wt % of a dispersion of yellow iron oxide particles as an inorganic pigment (WD-TIOY30 manufactured by DAITO KASEI KOGYO CO., LTD.), and 2.5 wt % of DAITOSOL 3000SLPN (manufactured by DAITO KASEI KOGYO CO., LTD.) including an acrylic emulsion as a main component. The printed sheets were allowed to stand at room temperature or 50° C. for a prescribed time, and the ink fixation properties under the respective conditions of the standing for the prescribed time were evaluated. The ink fixation properties were evaluated based on whether or not the ink was transferred to a piece of tissue paper pressed against the printed pattern, and were rated in 4 grades: ⊙: The ink was fixed within 5 minutes. ○: The ink was fixed within 10 minutes. Δ: The ink was fixed within 30 minutes. x: The ink was not fixed in 30 minutes.

Table 5 describes the results of the experiments which evaluated the ink fixation properties of the polylactic acid sheets having the various thicknesses.

TABLE 5

| | | Polylactic acid film thickness (nm) | | |
|---|---|---|---|---|
| | | 200 | 500 | 1000 |
| Ink fixation properties | Room temperature | ⊙ | Δ | × Fixed in 60 min. |
| | 50° C. | ⊙ | ⊙ | — |

The results described in Table 5 show that the ink fixation properties were changed depending on the film thicknesses of the polylactic acid sheets. The polylactic acid sheets having a larger film thickness showed lower water permeation properties and also exhibited lower adhesion with respect to the filter paper as the support. Consequently, the efficiency in the absorption of water into the support was decreased and poor ink fixation properties were caused. Thus, it was demonstrated that the film thickness of the polylactic acid sheets was desirably not more than 500 nm, and more desirably not more than 200 nm.

While the printing method in the present disclosure has been illustrated hereinabove, the configurations shown in the specification are only illustrative and various modifications thereto are possible without departing from the spirit of the present disclosure. Further, it is needless to mention that the configurations described in the specification provide other various effects.

The present disclosure may provide a printing method and a printing apparatus for applying inks to thin sheets, and thus may provide cosmetic sheets or wound-protection medical sheets which may be applied to the skin without the use of adhesives.

What is claimed is:

1. A method of producing an adhesive sheet for skin comprising:

attaching a water-absorptive support to a water-permeable biocompatible film to prepare a stack including the biocompatible film and the support; and applying an aqueous ink including water and a functional material to the biocompatible film of the stack so that the functional material is absorbed and fixed in the biocompatible film, and separating the biocompatible film having the functional material absorbed and fixed therein from the support.

2. The method of producing an adhesive sheet for skin according to claim 1, wherein the aqueous ink is applied by printing.

3. The method of producing an adhesive sheet for skin according to claim 1, wherein the biocompatible film has a film thickness T, where 10 nm≤T≤800 nm.

4. The method of producing an adhesive sheet for skin according to claim 1, wherein the ink further includes glycerol.

5. The method of producing an adhesive sheet for skin according to claim 4, wherein the ink further includes a diol solvent.

6. The method of producing an adhesive sheet for skin according to claim 1, wherein the support has a water absorbing capacity of not less than 1 mg per 1 $mm^2$.

7. A cosmetic method comprising:

separating a water-permeable biocompatible film having a coloring material absorbed and fixed therein from a water-absorptive support, the coloring material being applied to the biocompatible film by such a manner that the water-absorptive support is attached to the water-permeable biocompatible film, and an aqueous ink including water and the coloring material is applied to the biocompatible film; and applying the separated biocompatible film to skin.

8. An adhesive sheet for skin comprising:

a water-permeable biocompatible film in which an aqueous ink including a functional material has been absorbed and fixed; and a water-absorptive support detachably attached to the biocompatible film, wherein the biocompatible film contains at least one selected from the group consisting of polylactic acid, a cellulose, hyaluronic acid, corn starch, and salts thereof.

9. The adhesive sheet for skin according to claim 8, wherein the aqueous ink has been applied by printing.

10. The adhesive sheet for skin according to claim 8, wherein the biocompatible film has a film thickness T, where 10 nm≤T≤800 nm.

11. The adhesive sheet for skin according to claim 8, wherein the ink further includes glycerol.

12. The adhesive sheet for skin according to claim 11, wherein the ink further includes a diol solvent.

13. The adhesive sheet for skin according to claim 8, wherein the support has a water absorbing capacity of not less than 1 mg per 1 $mm^2$.

14. The adhesive sheet for skin according to claim 8, wherein the functional material is a coloring material.

15. The method of producing an adhesive sheet for skin according to claim 1, wherein the functional material is a coloring material.

16. The method of producing an adhesive sheet for skin according to claim 1, wherein the biocompatible film contains at least one selected from the group consisting of polylactic acid, a cellulose, hyaluronic acid, corn starch, and salts thereof.

* * * * *